United States Patent [19]

Belokin, Jr.

[11] 3,984,931

[45] Oct. 12, 1976

[54] ILLUMINATED OVERHEAD ADVERTISING DISPLAY

[76] Inventor: Paul Belokin, Jr., Rte. 4, Hayward, Wis. 54843

[22] Filed: Aug. 28, 1975

[21] Appl. No.: 608,771

[52] U.S. Cl. ..... 40/130 C; 40/128

[51] Int. Cl.[2] ..... G09F 13/00

[58] Field of Search ..... 40/131, 130 R, 132 R, 40/140, 142

[56] References Cited

UNITED STATES PATENTS

| | | | |
|---|---|---|---|
| 1,315,892 | 9/1919 | Wilson | 40/143 X |
| 1,824,620 | 9/1931 | Palmer | 40/131 |
| 2,928,197 | 3/1960 | Zuckerman | 40/128 X |
| 3,358,394 | 12/1967 | Braude | 40/132 |
| 3,413,745 | 12/1968 | Cabe | 40/132 |
| 3,483,647 | 12/1969 | Slavsky | 40/143 |
| 3,869,606 | 3/1975 | Fordsman | 240/51.11 R |

*Primary Examiner*—Louis G. Mancene
*Assistant Examiner*—Wenceslao J. Contreras
*Attorney, Agent, or Firm*—Watson D. Harbaugh

[57] ABSTRACT

A cross-sectionally V-shaped, improved display sign illuminated by overhead lights and locatable at any selectable level without interference with floor level lighting in stores having different height ceilings with ceiling supported fluorescent lighting fixtures, the sign receiving substantially vertical rays of light which it deflects at a selectable determined angle approaching horizontal.

11 Claims, 10 Drawing Figures

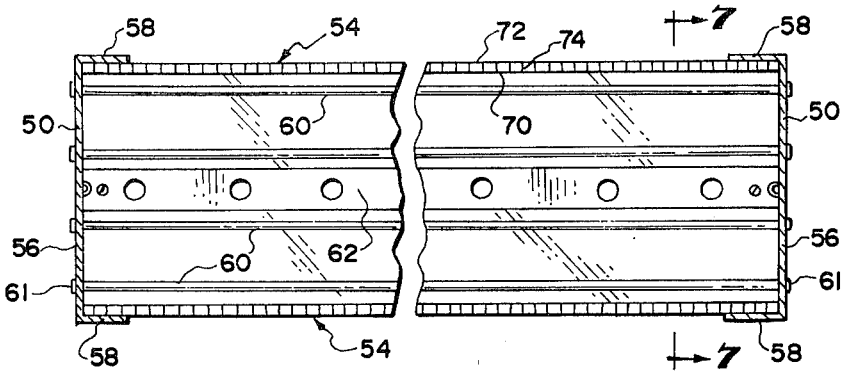
FIG. 6
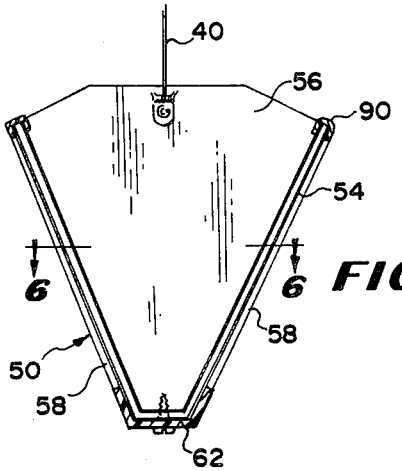
FIG 7
FIG. 8
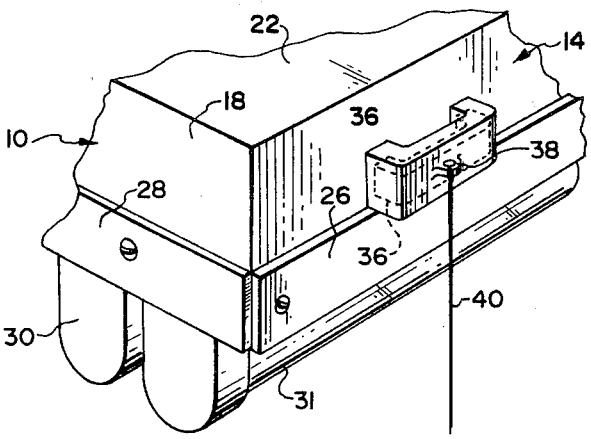
FIG. 10
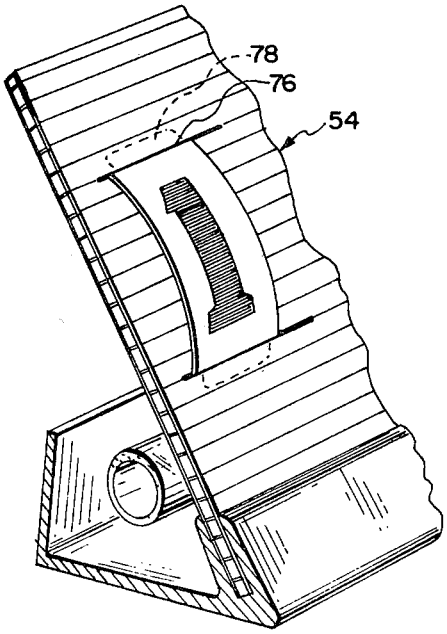
FIG. 9
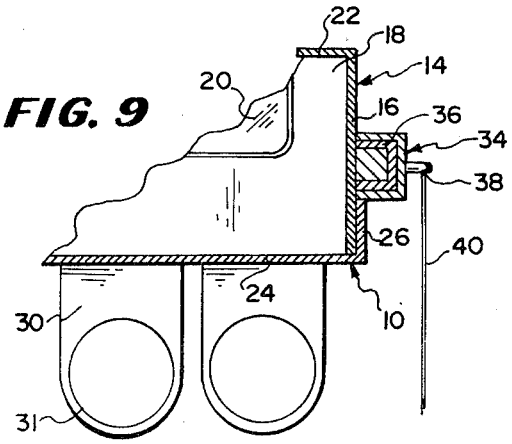

ILLUMINATED OVERHEAD ADVERTISING DISPLAY

BACKGROUND OF THE INVENTION

Heretofore store signs have been disposed below light sources but are objectionable in that they interfere with desired illumination of display counters. Where fluorescent lights are employed, signs may be hung on the fluorescent tubes but this locates the signs too high to be useful. Signs that are below the tubes do not generally make use of light rays that are available to accentuate a message or the presence of the sign. In some instances light is reflected through cut-out letters that are objectionably unidirectional in their viewing significance because the spaceing between the illuminating source and the openings geometrically leave end portions of a sign ineffectively illuminated when a viewing angle foreshortens the effective length of the sign as when viewed at an angle. On the other hand, whether translucent or otherwise, signs when located close to or in contact with a fluorescent light tube provide an unevenness of illumination that is objectionable. Such is not corrected adequately by endeavoring at additional expense to vary the translucency correspondingly throughout its height for uniformity.

Moreover, although back illumination of a translucent sign panel is known, in substantially all instances, the available light rays originate directly behind the sign and are handled separately and apart from the floor lighting. Even though the panel may be located at any level, it requires special hangers, wiring, switching, and fixtures. The expenses involved discourage this form of lighting particularly with respect to attention attracting signs and location indicator signs in stores large enough to have many departments. Essentially, such lighting is represented by Exit signs required by law or signs supported in close proximity to the light and generally behind the light. Moreover, such signs are difficult to change or relocate.

SUMMARY

In the present invention where fluorescent lights are most often mounted on the ceiling, a translucent display is suspended an adjustably spaced distance below a 4 or 8-foot fluorescent light fixture and the plane of the sign is inclined to incident rays from one or both of the fluorescent tubes striking it. The inclination from the vertical, approximately 30°, is such that only substantially vertical rays from at least one of the tubes are diffused and deflected through the sign viewed in a substantially horizontal direction by a person on the floor beneath the level of the sign while the rest of the rays provide room and floor lighting. Generally, less than a 30° angle of the rays radiating from the fluorescent tubes for illumination are used for the sign and at least a 300° angle of radiation remains unobstructed for room lighting even if the sign is as long as the radiating elements.

Moreover, it is preferred to employ a translucent corrugated plastic panel of inexpensive polyethylene or the like with letters removably secured thereto by tabs on the letters being received in narrow slots in the translucent member with a snap action to provide "day-glo" coloring contrast effects as well as changeable sign panels or indicia on the panel, or both.

The sign is also preferably a double-sided sign for two-way viewing with the end edges of the translucent elements releasably held by decorative end members with their top edges spread a distance approximately the width of the lighting fixture. The sign thereby defines a trough-like fixture receiving the incident vertical light rays against outwardly inclined light transmitting panels that preferably have planar surfaces facing laterally and downwardly. The inclination and resulting structure would also minimize the need for dusting and cleaning polished surfaces. The corrugations in the panels accept the substantially vertical incident light rays and diffuse them laterally as well as horizontally with a wide angle effect while providing a uniform back lighting effect on the viewer's side of the sign.

The signs are preferably provided with means for adapting their location and elevation to room conditions, it being appreciated that the best advertising display is one that in addition to being attractive is illuminated with an even light as though from within to avoid reflections, and is located above an illuminated walkway or display area, just above eye level where it is readily seen and glanced at repeatedly with the viewed plane being disposed essentially square to the average line of sight of its observers.

Moreover, the corrugated surface will not mirror or reflect flashes of other sources of light regardless of movement or location of the sign, the observer or any sources of light in the environment. Yet the signs can be animated bodily to invite attention by artificial air movement or natural circulation of air in the room.

An object of the invention is to provide a sign that requires a minimum amount of attention from the owner yet attracts the greatest amount of attention from customers; is easy to hang and relocate; is readily accessible for ease in changing indicia or sign panels; and will always be lighted whenever room lights are "on" and not lighted when the room lights are "off", thereby providing indirectly a single common control for room lights and signs wherever they are located.

A further object of the invention is to readily support the major weight of the sign on an upper edge of a vertical flange portion that overlaps the side walls of the light fixture ballast housing. The support element when weight-supported on the upper edge is held by magnets against inadvertent loosening yet is readily and manually releasable and includes a variable length drop support interconnecting the magnet and sign.

IN THE DRAWINGS

FIG. 6 is a section taken on line 6—6 in FIG. 7 with sign panels having the vertical light diffusing walls of FIG. 5;

FIG. 7 is a section on line 7—7 in FIG. 6;

FIG. 8 is an enlarged perspective corner view from above the ballast housing of the fixture illustrating the sign support means as located on the ballast housing;

FIG. 9 is a cross-section through the ballast housing and another embodiment of the support means; and FIG. 10 is a perspective view of the sign panel in FIG. 4 as used on a display cabinet in a store.

DESCRIPTION OF PREFERRED EMBODIMENTS

Figure 1:
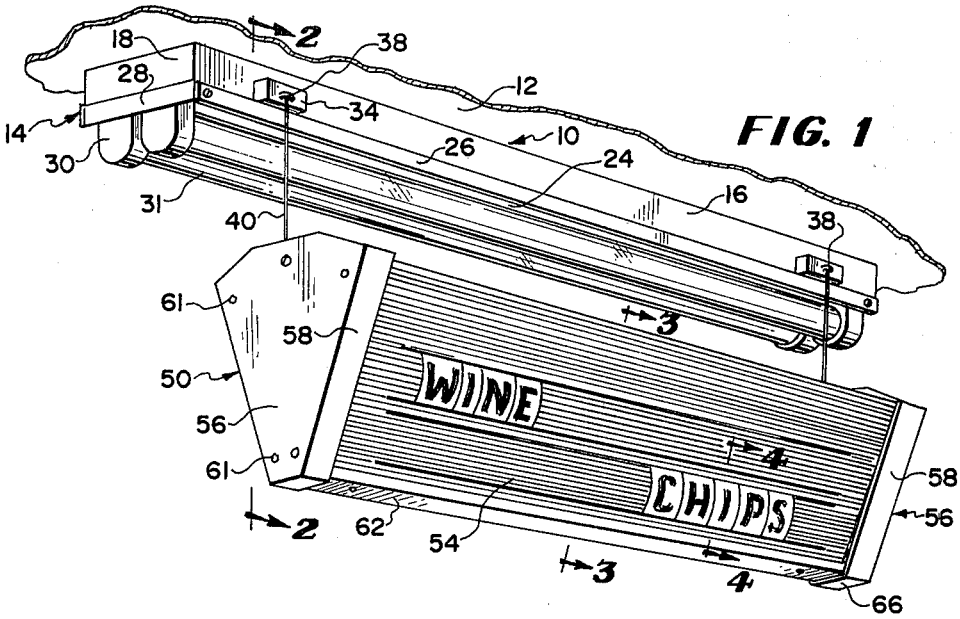
FIG. 1 is a perspective view of an embodiment of the invention in which the sign is detachably supported on the ballast housing of a twin tube fluorescent light.

Referring now to the embodiment shown in FIG. 1, a fluorescent light fixture 10 is shown in a conventional position supported well above the floor or a display cabinet (not shown) in a room. By way of example, it is shown mounted on the ceiling 12 and has a housing 14 of a ferrous metal with vertical side walls 16 and end walls 18 (FIG. 9) which are open at the bottom through which the fluorescent circuit ballast 20 is installed against the top wall 22. A bottom cover member 24 having upturned side flanges 26 and end flanges 28 that overlap the vertical side walls 16 and 18 generally carry the fluorescent light receptacle 30 which receive fluorescent tubes 31. The upper edges of the cover 24 serve as upwardly facing shoulders 32. Weight supporting members 34 rest on the shoulder 32 (FIG. 8) and are held against the side walls 16 by magnets 36 preferably with the ends of the U-shaped magnets against the side 16 with the magnet preferably near the top of the supporting member 34 for the greatest weight support leverage as related to an apertured ear 38 on the back of each member 34, which receives a braided cord 40 therethrough. However, since the supporting member 34 with the cord 40 secured to the ear 38 can be manually disposed with either side up, the magnet is illustrated as located at the vertical center of the contacting surface of the supporting member 34.

Figure 2:
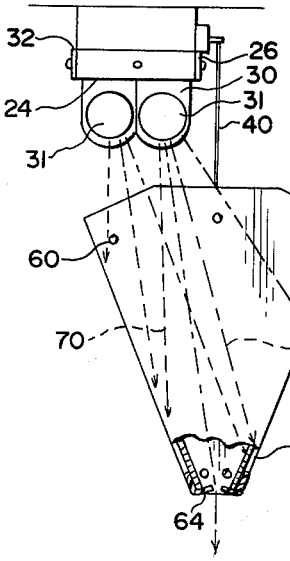
FIG. 2 is an end view of the fixture and sign illustrating the preferred position of the releasable magnetic support of the sign in one of many selective locations of optimum places and positions for viewing.

As shown in FIG. 1, the ears 38 are then disposed laterally of the housing 14 and the fluorescent tubes 31 located in the receptacle 30 provide light rays 42. As illustrated in FIG. 2, the fluorescent light rays 42 fan out laterally about the tubes 31 to illuminate a room, show cases and aisles (not shown) on the floor of the room.

A sign 50 is adjustably suspended on the cords 40 at any desired height, but preferably high enough for a person looking for sign information can see and read those signs close to him at a reasonable viewing distance. Thus, if desired, it is possible to have cords 40 of spaced signs of progressively increasing adjusted lengths in a direction away from a store entrance for a unitizing effect of all the signs. Accordingly, it is preferred for an acceptable illumination and viewing of the signs that the sign panel 58 be inclined towards the view (FIG. 4) so that it is disposed substantially normal to the expected line of sight 55 and also at an acute angle to all overhead lighting fixtures to prevent reflection if surface panels employed are highly reflective as distinguished from the diffused light transmitted by the panels. Moreover, with the flexibility of the support, the signs can swing with attention attracting movement with air circulating in the room.

Although the sign fixture may be provided with more than one sign panel, arranged as a triangle or a rectangle, it utilizes overhead fluorescent light to illuminate a sign panel or panels by transmitting overhead light through the panels.

The invention is described in connection with two sign panels 54 with end members 56 defining pairs of flanges 58 providing opposing supports for the panels.

The panels are inclined outwardly at their tops at approximately 60° from each other.

Figure 3:
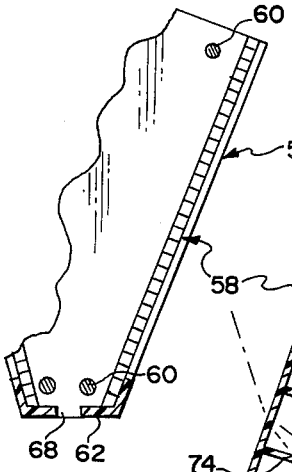
FIG. 3 is a vertical cross-section of the sign taken on line 3—3 in FIG. 1.

The end members 56 supporting the panels are suitably decorative and are held spaced apart by spacer rods 60 and clamping screws 61 engaging the end members 56 adjacent the flanges 58 (FIG. 3) so that the panels 54 when slipped into place may rest against the flanges 58 and be urged by gravity to move back against the flanges if momentarily moved from their resting position. At the bottom of the sign 50, the lower ends of the flanges 58 are disposed close to one another.

The sign panels 54 may be supported against dropping out in either one of two ways. The lower ends of the flanges 58 may have tab extensions 64 (FIG. 2) bent inwardly to engage the lower edge of the sign panel at their ends. This enables installation or a changing of the sign panels from below merely by inserting and moving them upwardly between the lower spacer rods 60 and over them for their lower edges to lean into place against the flanges 58. Or, preferably, as illustrated in FIG. 1, the panels may be supported by a channel member 62 that rests on the horizontally flange portions 66 (FIG. 1) which provides a lower marginal protection and frame-like element for the lower edge of the sign panel.

In the latter mode, the sign may be easily inserted and removed from above the sign between the flanges 58 and the upper spacer rods 60. However, in both modes of installation, the bottom of the sign is open or has openings 68 to provide some ventilation and a means for cleaning the bottom of debris that collects there over a period of time.

As illustrated in FIG. 2, the incident light ray pattern of the fluorescent tubes upon the sign panels are illustrated by the broken line arrows 70 where the sign is shown as located in its closest relationship with the fluorescent light fixture 10 in a low ceiling room. When located a greater distance from higher ceilings as where it may be spaced a distance of as much as 10 or 12 feet therefrom in a department store of large floor area, the incident rays approach parallel and the rays from other fluorescent lighting fixtures therearound also provide incident rays to the sign panels.

Although the sign panels 54 may cross-sectionally have a wave form if the waves extend horizontally, it is preferred to provide a cellular 2-sided corrugated plastic sheet molded of inexpensive translucent polyethylene, or like material, for planar strength. Slots through only one face side thereof in accordance with the invention do not materially weaken the planar stiffness against deflection when handled and mounted in the sign whether the cross walls run horizontally or vertically. Such a sheet, rated at a weight of 78 grams, is preferred which is approximately ⅛ inch thick. The panel preferably is treated to diffuse transmitted light on at least four surfaces in any natural or lightly tinted color. Such provides a desirable unit for ease of handling and performance in the invention.

Figure 4:
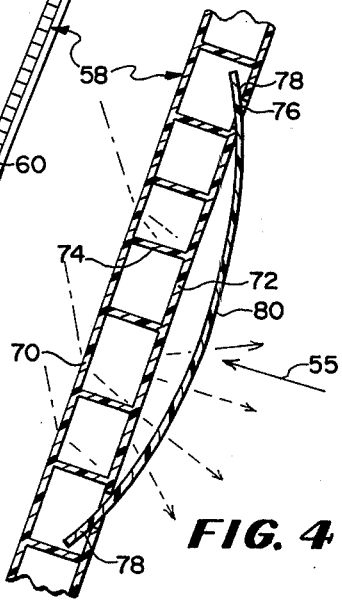
FIG. 4 is a vertical section taken on line 4—4 of FIG. 1 through the translucent indicia portion of the sign showing the releasable mounting of indicia of the sign.
Figure 5:
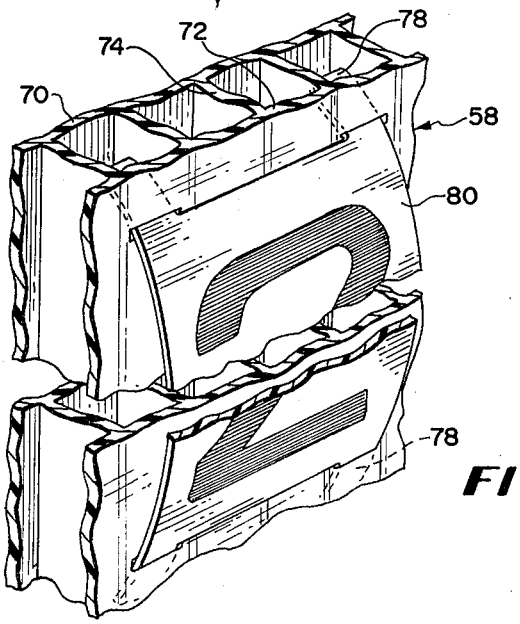
FIG. 5 is an enlarged perspective sectional view illustrating the detachable mounting of the indicia members upon the back-illuminated sign panel having vertical light diffusing cross walls.

As shown in the enlarged sectional views of FIGS. 4 and 5, the panel 54 is cellular, being extrusion molded to provide two parallel outside or face walls 70 and 72 and parallel cross walls 74. The wall 72 has parallel limited length slots 76 through it without affecting the strength of the cross walls 74. In FIG. 4 where the panel is to be used with the cross walls extending horizontally, the slots are parallel with and located between the cross walls. They are of moderate length as shown in FIG. 10. In FIG. 5, where the panels are provided with the cross walls extending vertically, the slots are normal to the cross walls without encroachment upon the cross walls. The parallel slots 76 are employed to receive the tabs 78 formed on snap-in letters 80.

An advantage with panels having vertically disposed cross walls 74 (FIG. 5) is that the narrow tabs are located preferably at the horizontal edge of each letter 80 and are of a narrow size to be received through the slots between two cross walls 74. Thereby, when making up the sign with snap-in letters, the space between letters is automatically provided for even spacing and background lighting around each letter for the ready identification of words and indicia. Also, once applied, the letters are held against lateral movement by the cross walls 74.

Accordingly, the strength and lightness ratio of the sign not only provides a rigid sign panel for easy handling without the snap-in letter tabs extending through the other side of the panel, yet the length of the tabs is preferably enough greater than the thickness of the panel that once pressed into place they tend to flatten out again and bind the root of the tab in the slot. Accordingly, all letters are held in a straight line against the edges of the slot and between the cross walls.

With horizontally disposed cross walls snap-in letters can be employed with wider tabs and the panel wall 72 can be slotted with respect to the width of the tabs 78. However, in this embodiment, the length of the tab is preferably less than the distance between cross walls. In both embodiments, the tab receiving slots are spaced and of limited length so that the planar strength against bending of the panel is preserved.

As shown in FIG. 7 where the cross walls are disposed vertically, a finishing cap strip 90 may be employed to coact with the other structure to frame the panel, but more important, it prevents debris from entering the vertically disposed openings. However, it should be noted that both panels are demountable and after each use can be washed clean inside and outside with water and detergent, thereby assuring the continuance of a high transmissity of light through comparatively thin walls as compared with a solid sheet panel of equal stiffness. With the latter, tab receiving slots would extend all the way through and be contacted quite often and snap out of place. This inadvertently would occur repeatedly when changing sign panels if the letter tabs were not concealed or protected as in the present invention.

A further advantage of the invention is that the flexible cord 40 will permit the sign 50 to be tilted approximately 90° to replace the panels if not otherwise convenient to remove them. Also, one of the magnets can be disengaged momentarily for the same purpose, it being appreciated that the invention can be disposed at any distance from the fluorescent fixture wherever it is located in accordance with the desires of the store owner, it having a universal convenience for all stores lighted by fluorescent fixtures. Moreover, it is disposed above the reach of customers without any inconvenience to servicing the fluorescent fixtures and without any alteration of the room or lighting fixture when installing or removing the sign.

Also, as noted in FIG. 2, the sign can be hung on the side of the fluorescent fixture that is closer to the viewer, if desired, for greater use of incident light rays through the panel that is nearest to the concerned observers.

A modified use of the sign panel is illustrated in FIG. 10. Since the panel is light enough that it can be used as a counter top item, it can be disposed at an optimum viewing angle on a showcase top merely by locating the lower edge in an inclined slot of a portable stand that sets on top of a counter or shelf. In this use the sign may be illuminated from the observer's side as well as from behind. Here, particularly, the appearance of the sign panel is excellent since there are no tabs exposed on the back of the sign if lighted from below by a tubular fluorescent or filament tube.

I claim:

1. An overhead sign illuminated from a distance outside its confines comprising:

a horizontally elongated lighting fixture, having a housing supported on a wall of a room and an elongated source of radiating parallel rays of light disposed in a plurality of diverging planes that have a substantially common axis of intersection for illumination in said room, a translucent panel spaced from said axis and disposed with its light receiving face substantially parallel with said axis and disposed at an acute angle of inclination to a portion of said diverging planes where it may be viewed at approximately a right angle to the line of sight of people in said room, means for supporting the source of light and said panel a spaced distance greater than the width of the panel for minimizing the quantum of rays from said source that are interrupted thereby with respect to the use of remaining rays for room illumination, said panel including means for diffusing parallel rays of light passing through it viewed by said people, and means on said panel including indicia proximate the face thereof absorbing patterns of light rays for viewing readability.

2. The sign defined in claim 1 in which said source of light is a fluorescent light tube located below the ceiling of the room.

3. The sign defined in claim 2 in which the tube is supported by a housing having a horizontally offset flange adjacent lower edges of the housing.

4. The sign defined in claim 3 in which said supporting means includes a magnet magnetically resting against a vertical side of the housing with its lower edges removably resting on said flange.

5. The sign defined in claim 4 in which said supporting means includes a flexible hanger interconnecting said magnet and said panel.

6. The sign defined in claim 1 in which said sign is a two panel sign essentially V-shaped in cross section with the distance between the upper edges greater than the width of the lighting fixture.

7. The sign defined in claim 1 in which said diffusing means comprises walls defining corrugations in said translucent panel.

8. The sign defined in claim 1 in which said diffusing means has horizontal slots therein and the sign has indicia with snap-in tabs received in said slots.

9. The sign defined in claim 1 in which said panel comprises horizontally spaced portions interconnected by transverse translucent web portions.

10. An overhead sign illuminated at an acute angle by an elongated fluorescent light fixture having a housing defining upwardly facing shoulders, magnetic weight supporting members resting on said shoulders and magnetically engaging the housing in sheer relation and including flexible means depending therefrom in supported relation, sign means having spaced end members supported on said flexible means and in turn releasably receiving and supporting a translucent sign panel disposed at an acute angle to light rays from the fluorescent fixture, said sign panel carrying indicia on the side exposed to the observer.

11. The combination defined in claim 10 in which said sign means comprises a molded plastic member having two spaced translucent face walls interconnected and rigidified by spaced cross walls.

* * * * *